United States Patent [19]

Paige et al.

[11] Patent Number: 4,773,793

[45] Date of Patent: Sep. 27, 1988

[54] PILE HAVING DOUBLE CONE ANCHOR

[75] Inventors: Marshall A. Paige, Pass Christian, Miss.; Robert E. Van Olst, Mandeville, La.

[73] Assignee: The United States of America as represented by the Secretary of the Navy, Washington, D.C.

[21] Appl. No.: 46,344

[22] Filed: Apr. 29, 1987

[51] Int. Cl.[4] ..... E02D 5/54

[52] U.S. Cl. ..... 405/231; 405/226; 405/248; 405/244

[58] Field of Search ..... 405/208, 224, 226, 228, 405/231, 232, 244, 248, 253, 256

[56] References Cited

U.S. PATENT DOCUMENTS

| | | | |
|---|---|---|---|
| 3,636,718 | 1/1972 | Keates | 405/248 |
| 3,975,917 | 8/1976 | Asayama | 405/232 |
| 4,254,730 | 3/1981 | Crenshaw | 405/208 X |
| 4,543,015 | 9/1985 | Kruse | 405/256 |

FOREIGN PATENT DOCUMENTS

| | | | |
|---|---|---|---|
| 1178838 | 9/1985 | U.S.S.R. | 405/228 |
| 10976 | 5/1909 | United Kingdom | 405/253 |

*Primary Examiner*—David H. Corbin

*Attorney, Agent, or Firm*—Thomas M. Phillips

[57] ABSTRACT

A light weight pile having increased load bearing capacity for being embedded in the ocean floor. Two cones are welded together at their base. An opening of about one third the diameter of the base is made in the apex of each of the cones to provide an opening for a hollow pile to pass through. The double cone is attached to the pile so that it can be water jetted into the ocean floor.

1 Claim, 1 Drawing Sheet

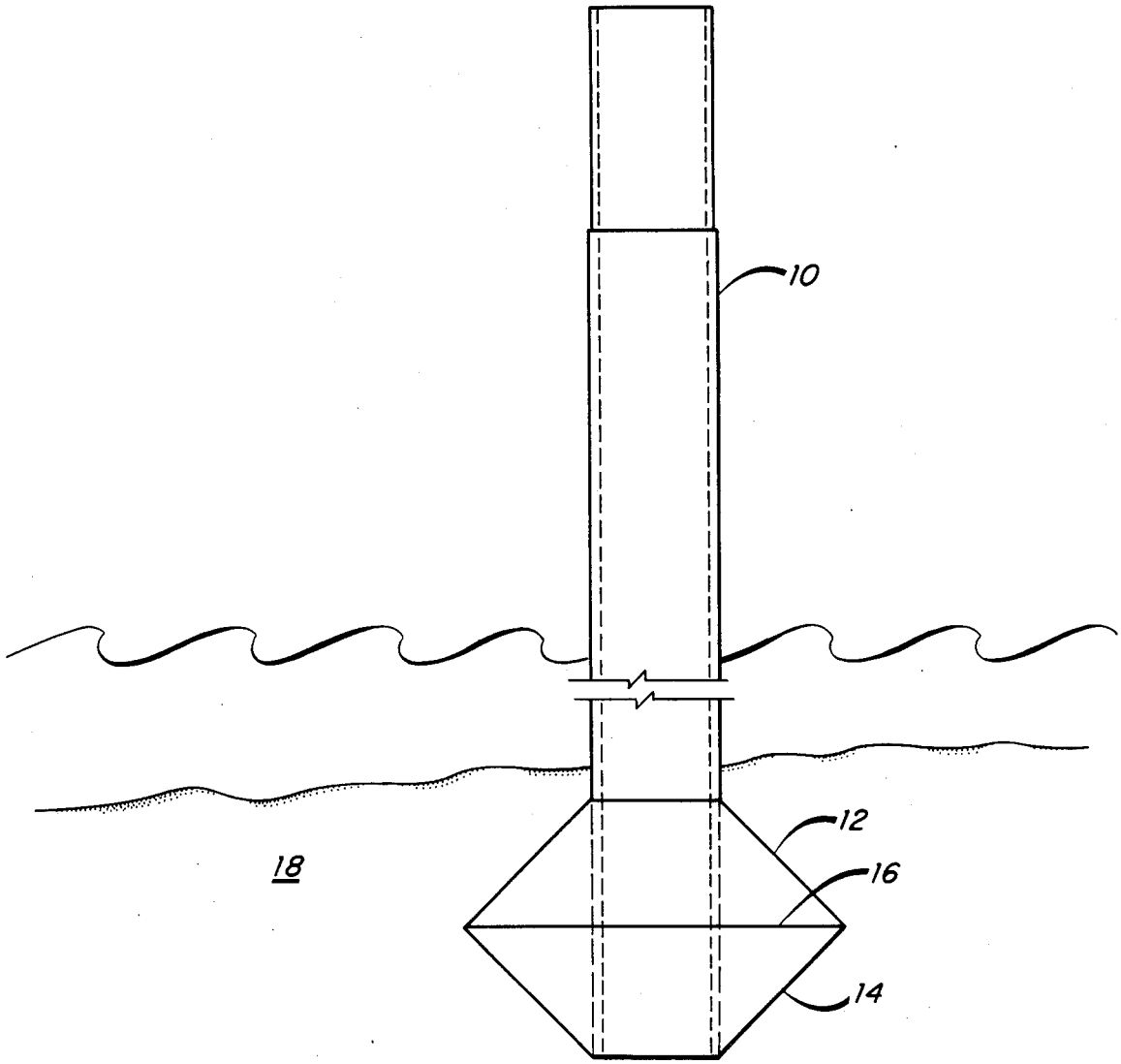
10
12
16
14
18

PILE HAVING DOUBLE CONE ANCHOR

BACKGROUND OF THE INVENTION

1. Field of the Invention

The present invention relates to anchoring structures in the ocean floor and more particularly to anchor structure that provides increased pullout resistance in the vertical direction.

2. Description of the Prior Art

Piles are normally installed to a depth sufficient to develop the required load bearing or pullout capacity as a result of friction forces acting on the surface of the piles. The primary disadvantage of this method is that the pile length must be great to achieve the required load bearing capacity. There are also available water jetted piles such as disclosed in U.S. Pat. No. 3,636,718 whose weighted downward pointing cone shaped tip facilitates its deployment. This pile is filled with concrete and would be difficult to install from a small boat without the help of elaborate equipment.

SUMMARY OF THE INVENTION

The present invention provides for using a double cone anchor attached to the lower end of a short pile. The unique feature of the invention is the addition to a downward pointed cone of an upward-pointing cone which increases pullout resistance by a factor of at least four times without increasing the overall diameter of the cone anchor.

Accordingly, an object of the invention is the provision of an anchored pile using a bicone anchor whose pullout resistance is increased by a factor of four over an anchor with a single downward facing cone.

Other objects, advantages and novel features of the invention will be apparent from the following detailed description of the invention when considered in conjunction with the accompanying drawings wherein there is shown in the single FIGURE, the preferred embodiment of our invention.

Referring now to the FIGURE wherein there is depicted an anchored piling constructed in accordance with the present invention. Secured to pile 10 are two ninety degree cones 12, 14 welded together at their base 16. Piling 10 extends through the double cone (bicone) structure forming a conduit through which water can be jetted to cause the anchor assembly to submerge into the soil 18.

The diameter of the bases of the inverted cones should be on the order of three times the diameter of the pipe 10.

Obviously many modifications and variations of the present invention are possible in light of the above teachings. It is therefore to be understood that within the scope of the appended claims the invention may be practiced otherwise than specifically described.

What is claimed:

1. A lightweight pile having increased load bearing capacity and increased uplift capacity for being embedded in the ocean floor, the combination comprising:

first and second ninety degree cones having their bases of equal diameter so as to form a bicone, the apex area of each of said cones being removed to provide an opening approximately one third the diameter of its base, the bases of said cones being joined to form an integral bicone, and a pile being positioned through the opening of one of said cones and extending to the opening of the other of said cones where it is rigidly affixed thereto.

* * * * *